US006147333A

United States Patent [19]

Mattson

[11] Patent Number: 6,147,333

[45] Date of Patent: Nov. 14, 2000

[54] BREAKER BLANKET HEATING AND INSULATION UNIT

[75] Inventor: Russell O. Mattson, Two Harbors, Minn.

[73] Assignee: Metatech Corporation, Goleta, Calif.

[21] Appl. No.: 08/967,770

[22] Filed: Nov. 12, 1997

[51] Int. Cl.[7] ..... H05B 3/06

[52] U.S. Cl. ..... 219/531; 219/209; 219/531; 219/311; 219/497; 428/116; 428/241

[58] Field of Search ..... 219/209, 531, 219/311, 497, 19, 20, 535, 529, 549; 428/116, 241; 392/459

[56] References Cited

U.S. PATENT DOCUMENTS

| | | | |
|---|---|---|---|
| 1,991,276 | 2/1935 | Gebhard | 219/19 |
| 3,076,885 | 2/1963 | Bentley | 219/20 |
| 3,358,104 | 12/1967 | Cromer et al. | 200/128 |
| 3,721,798 | 3/1973 | Beierer | 219/209 |
| 4,524,264 | 6/1985 | Takeuchi et al. | 219/497 |
| 4,833,299 | 5/1989 | Estes | 219/311 |
| 5,039,567 | 8/1991 | Landi et al. | 428/116 |
| 5,193,669 | 3/1993 | Demeo et al. | 200/512 |
| 5,203,829 | 4/1993 | Fisk et al. | 119/96 |
| 5,256,131 | 10/1993 | Owens et al. | 493/374 |
| 5,370,926 | 12/1994 | Hopper | 428/241 |
| 5,630,894 | 5/1997 | Koch et al. | 156/64 |
| 5,680,944 | 10/1997 | Rueter | 215/13.1 |
| 5,813,486 | 9/1998 | Smith et al. | 182/3 |

*Primary Examiner*—Teresa Walberg
*Assistant Examiner*—Daniel L. Robinson
*Attorney, Agent, or Firm*—Merchant & Gould P.C.

[57] ABSTRACT

A circuit breaker tank heating insulation unit blanket and circuit breaker insulation blanket wherein the insulation blanket is comprised of an elongated fibrous insulation encased within a fabric that is impervious to the outdoor environment. The insulation blanket is detachably secured over and encircling the circuit breaker tank. The insulation blanket includes an attachment means for detachably securing the insulation blanket to the circuit breaker tank. The heating insulation unit being comprised of an insulation blanket and a heating system wherein the heating system is positioned in contact with the tank of the circuit breaker and encircled by the insulation blanket.

13 Claims, 5 Drawing Sheets

TYPICAL 115KV OR 230KV SF6 CIRCUIT BREAKER
TANK 2
BREAKER BLANKIT, 4 TWO PER TANK, ALSO SEE DETAIL 2 (CUTAWAY VIEW SHOWING FACING SIDE ONLY)
40
STEEL CIRCUIT BREAKER SUPPORT
CIRCUIT BREAKER BUSHINGS
STAINLESS STEEL SPRINGS WITH LATCH 8
34
12
HEATER & THERMOCOUPLE CABLES TO CONTROL CABINET
THERMOCOUPLE
36
10
6
38
2 WATT PER SQUARE INCH FLEXIBLE SILICON RUBBER HEATER

BREAKER BLANKET HEATING AND INSULATION UNIT

BACKGROUND

This invention relates to a heat insulator unit for puffer type and arc assisted type circuit breakers which utilize gas, such as sulfur hexafluoride ($SF_6$), as an electrical insulator, interrupting media and mechanical damper in the circuit breakers. Sulfur hexafluoride ($SF_6$) gas has unique properties that allow it to act as an electrical insulator, interrupting media and mechanical damper in circuit breakers. Those properties include: a high molecular weight; density that is about 4½ times that of air; excellent thermoconductor; and excellent electrical insulator. One serious drawback in the physical properties of $SF_6$ gas is that at normal utilization pressures it will liquefy at approximately −30° C. or −22° C. (temperature at which $SF_6$ gas will liquefy may vary with pressure). The liquification of the $SF_6$ can reduce the working pressure in the tank below minimum values for interruption or dielectric strength. Thus any circuit breaker utilizing $SF_6$ gas that is used in the northern tier of the United States, Canada, or elsewhere in cold weather climates around the world must have heaters for the $SF_6$ circuit breaker tanks.

In states such as North Dakota, Minnesota, Wisconsin and Montana, temperature can drop as low as −50° F. air and −75° F. wind-chill. Such temperatures cause severe operating duties on a Utility's electrical apparatus', in particular the Utility's $SF_6$ gas based circuit breakers. Although $SF_6$ gas based circuit breakers are specified to at least −40° C. and in some cases −45° or −50° C., Utility's are experiencing significant problems as a result of the cold weather. These problems include alarms being activated and in some instances circuit breaker lock-outs. An operating Utility is faced with three possible problems when cold weather begins to affect its circuit breakers. The first is the possibility that the sensors activating the alarm are defective. The second problem may be that the circuit breaker tank is low on gas. The third problem may be that the circuit breaker's $SF_6$ gas has liquefied (or become solid) as a result of the cold temperatures. In addition, a circuit breaker locking out may cause the additional problem of cascading failures. In any of these above listed possible problems, a service worker must be called out to determine the extent of the problem.

In order to operate circuit breakers utilizing $SF_6$ gas in extreme cold weather conditions, vendors have universally added additional heat to circuit breaker tanks. Venders add heat to the tanks through the use of heaters of various designs. Some of the heater designs are similar to those that are in a conventional electric oven. In this style, the heater is comprised of a heated tube that is enclosed in a configuration that partially surrounds the breaker tank. The heated tube is not in direct contact with the tank and simply heats the air immediately surrounding the heat tube. This type of heater typically uses a bandwidth for temperature control. The use of a bandwidth for the temperature control is necessary to allow for lead time from when the heater is turned on and to store sufficient heat in the tank. Otherwise, excessive cycling would occur. Because these types of heaters are heating the air surrounding the tank, and not the tank itself, they waste a tremendous amount of energy and require a tremendous amount of energy in order to raise the temperature of the tank. Further, these heaters are not insulated. Excessive amounts of electric heat to the circuit breaker tanks places an undue burden on the station service. Solving the circuit breaker tank temperature problems by adding additional heat simply exacerbates the Utility's peak demand problems. Peak demand is the worst time of operation for a utility to be using its own energy to run heaters because this is energy that is needed by customers.

In areas where the temperature drops as low as −50° F. air and −75° F. wind-chill, Utility's use a tremendous amount of energy for the circuit breaker tank heaters. Some vendors use as much as 8000 watts of heat per breaker. Notwithstanding the loss of revenue which could be generated from the sale of the energy used to run the heaters, the use of energy to run heaters is necessary in order to keep the gas within the breaker tanks from liquefying. A circuit breaker tank having a significant amount of $SF_6$ gas that liquefies renders it unoperational. The circuit breaker is not operational because liquefaction of the $SF_6$ gas causes the circuit breaker to be locked into an open or closed position by the control instruction.

A utility company may experience significant losses when its circuit breakers are not operational. The costs arise from the need to send qualified technicians to the site to verify status. Loss of customer load may also occur. The need to transfer trip circuit breakers may occur because of the circuit breaker being in a locked close position. This causes the circuit breaker to be non-operational, thereby enlarging the outage and time duration of a fault. There are also expenses resulting from a service call to the circuit breaker if the circuit breaker doesn't reset itself upon the gas pressure rising to an appropriate level.

Heaters that are presently being used on circuit breakers utilizing $SF_6$ gas are not designed for the effects the wind-chill can have on the exposed tank. There is a need for a heating system that addresses the ambient temperature as well as the rate at which the tank temperature and pressure will drop from extreme wind-chills. There is also a need for a heating system that is more energy efficient.

SUMMARY

According to the present invention, there is provided a circuit breaker tank heating insulation unit comprising a heating system that is positioned in contact with the tank of the circuit breaker tank, an insulation blanket that is comprised of an elongated fibrous insulation encased within a fabric that is impervious to common solvents detachably secured over and encircling the heating system and the circuit breaker tank, and an attachment means for detachably securing the insulation blanket to the circuit breaker tank. The circuit breaker tank heating insulation units heating system being comprised of a heating unit electrically connected to a heating controller wherein the heating unit is comprised of a flat elongated flexible silicon rubber having heater ribbon running therethrough. The circuit breaker tank heating insulation units attachment means is comprised of male connectors and female connectors attached at the edge of the insulation blanket, wherein the male connectors and female connectors engage to secure the insulation blanket around the circuit breaker tank upon encircling the insulation blanket around the breaker tank.

DETAILED DESCRIPTION

General

In the following detailed description of the invention, reference is made to the accompanying drawings which form a part hereof, and which is shown by way of illustration, specific embodiments in which the invention may be practiced. It to be understood that the other embodiments of the invention may be utilized and structural changes may be made without departing from the scope of the present invention.

Figure 1:
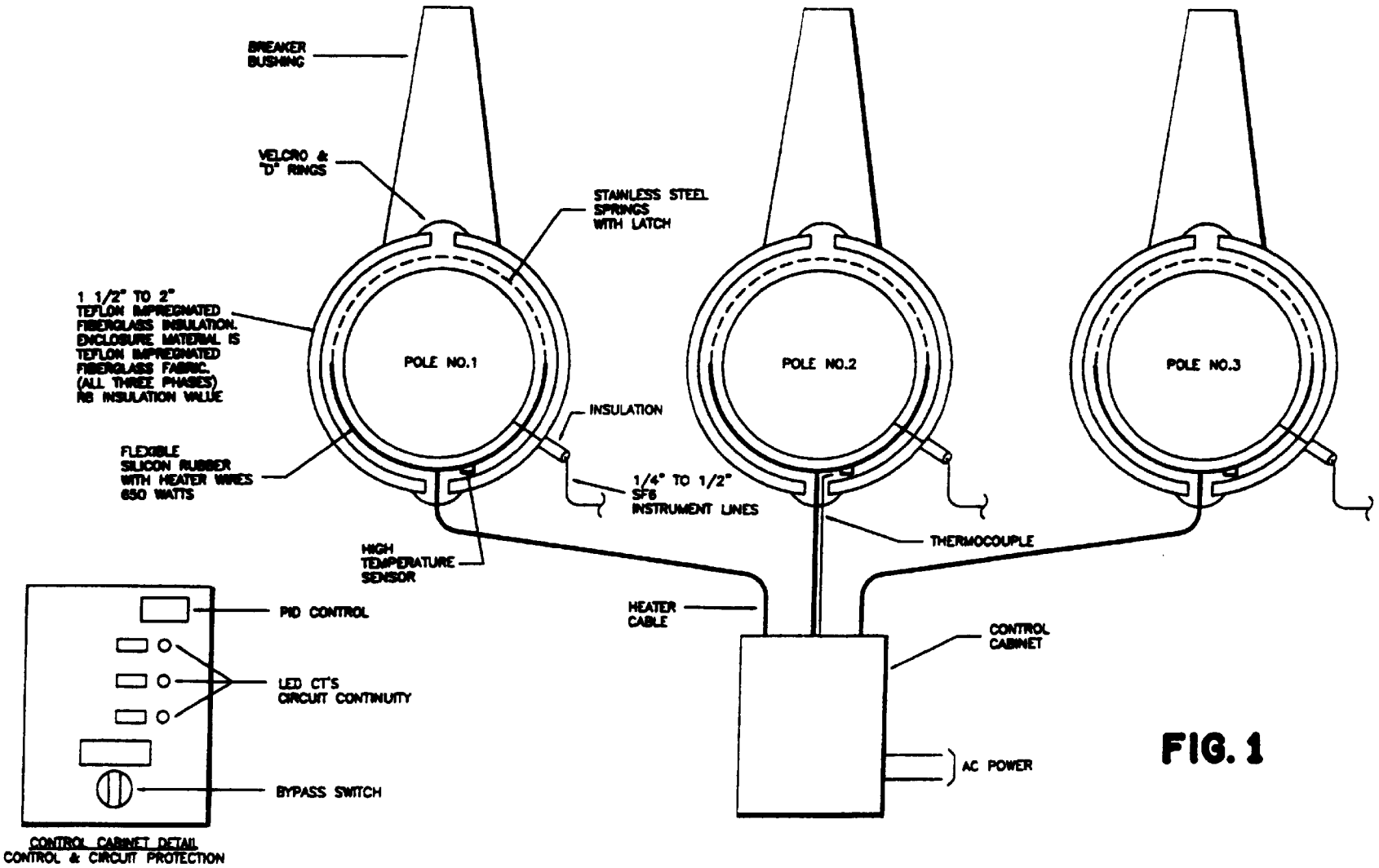
FIG. 1 is a cross sectional view of the circuit breaker showing the cross section of breaker tanks having a heater and breaker blanket attached thereto.
Figure 2:
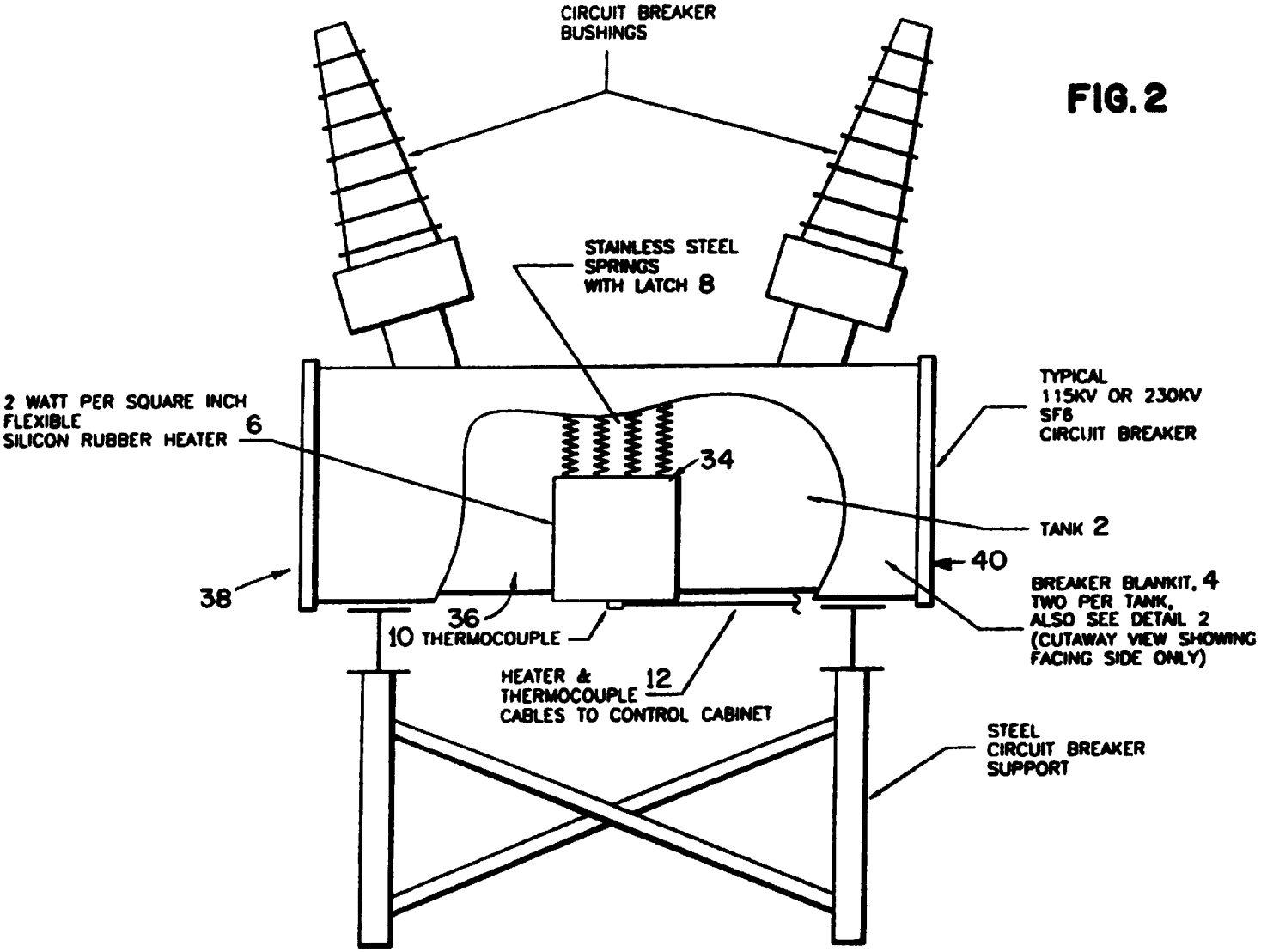
FIG. 2 is a side view of a breaker tank having a heater and breaker blanket attached thereon, wherein a portion of the breaker blanket is cut away to illustrate the heater and spring attachment assembly.
Figure 5:
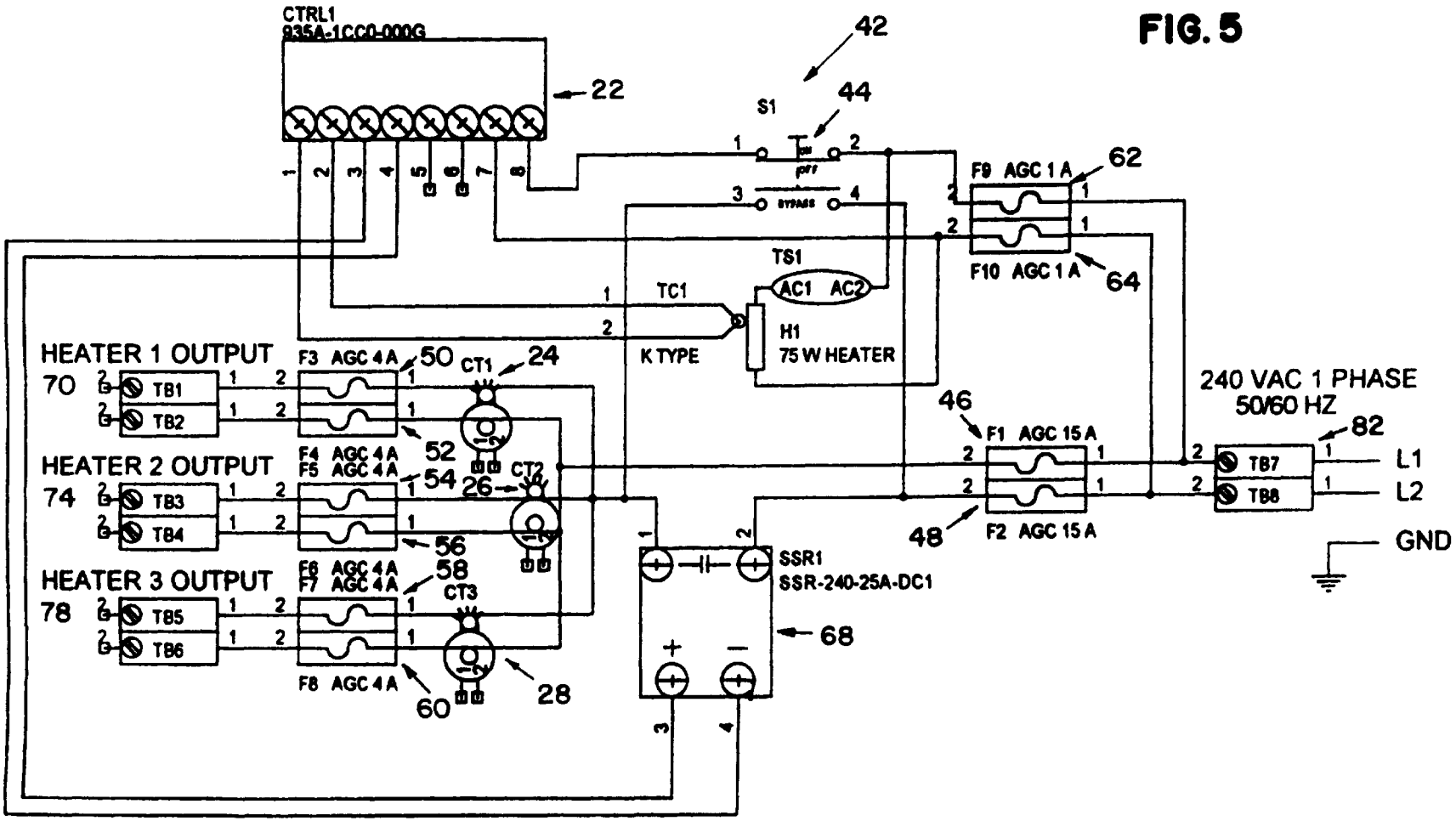
FIG. 5 is a schematic diagram of the heating unit control system circuitry.

Referring to FIGS. 1 and 2, the circuit breaker tank heating insulation unit 1 is comprised of a heating unit 6 and an insulation breaker blanket 4, wherein the heating unit 6 and the insulation breaker blanket 4 detachably engages the tank 2 of a circuit breaker. The heating unit 6 detachably engage the tank 2 of a circuit breaker through use of a stainless steel spring 8 and latch 16 connection system 8. The heating unit 6 and tank body 2 are detachably covered by the insulation breaker blanket 4. The stainless steel spring and latch 16 connection system of the heating unit 6 are attached along the first edge 34 of the heating unit 6 and the second edge of the heating unit as shown in FIG. 5. The stainless steel springs 8 encircle the tank 2 until connected by a latch 16. The stainless steel spring 8 and latch 8 connection system pull the heating unit 6 snugly into contact with the breaker tank 2 as shown in FIGS. 1 and 2.

The heating unit 6 is comprised of a flat elongated flexible silicon rubber 90 having heater ribbon of approximately 650–850 watts running therethrough depending on breaker tank physical size. The heating unit 6 is typically positioned in contact with the center of the circuit breaker tank 2 and wraps around a portion of the circumference of the tank 4, as illustrated in FIG. 2.

Figure 3:
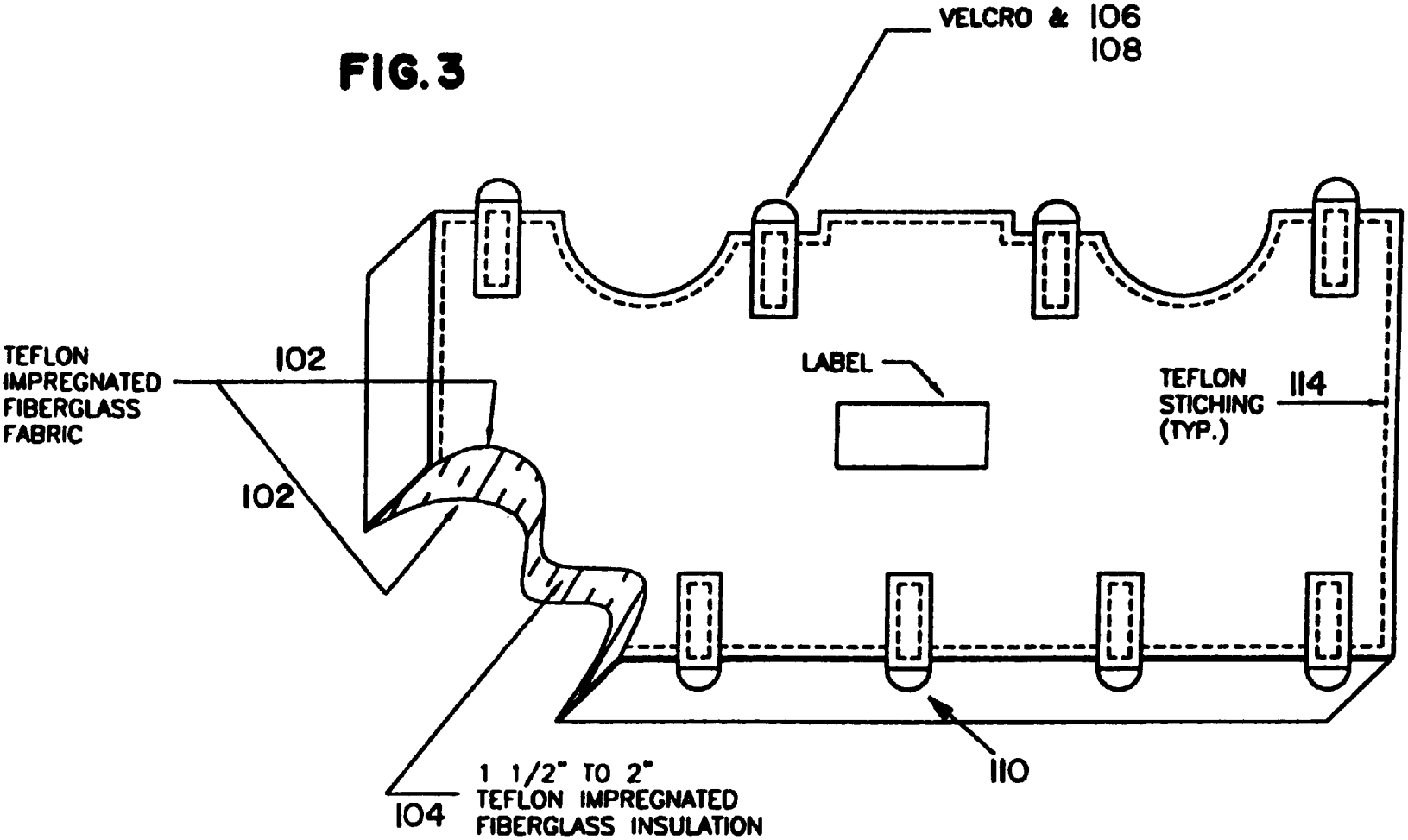
FIG. 3 is perspective view of the breaker blanket having a portion of the blanket cut away to illustrate the layers of components that comprise the blanket.

As shown in FIG. 3, the insulation breaker blanket 4 is comprised of an elongated fibrous insulation 104 encased within a fabric 102 that is impervious to, ultraviolet radiation, harsh outdoor environment and common solvents. The insulation breaker blanket 4 also includes connectors 106, 108 and 110 stitched to the edges of the exposed face 112 of the insulation breaker blanket 4. When in use, as shown in FIGS. 2 and 3, the insulation breaker blanket 4 encircles the circuit breaker tank 2 so that the body of the tank 36, the heating unit 6 and stainless steel springs 8 and latch connector 16 are completely covered. The first and second ends of the tank 38, 40 remain exposed to the environment.

SPECIFIC EMBODIMENT

Blanket

In one embodiment of the invention, the insulation breaker blanket 4 portion of the heating insulation unit 1 is comprised of a Teflon impregnated fiberglass insulation 104 which is encased by a Teflon impregnated fiberglass fabric 102. The primary function of the Teflon impregnated fabric 102 is to minimize the ingress of moisture and common solvents, including UV rays, into the breaker blanket's fiberglass insulation 104. The Teflon impregnated fabric 104 is also designed to shed water. The dimensions of the breaker blanket 4 are determined by the type of circuit breaker tank the breaker blanket 4 is being applied to, as the breaker blanket 4 is typically custom designed to fit the dimensions of each circuit breaker tank.

The breaker blanket 4 is applied to a circuit breaker tank 2 as shown in FIG. 2, wherein the breaker blanket 4 encases the body 36 of the circuit breaker tank 2 after being wrapped around and detachably secured to the circuit breaker tank 2 with connectors (not shown). In one embodiment, illustrated in FIG. 3, the connectors are male and female Velcro 106, 108 and a D-ring 110 connection system. However, it is to be understood that the present invention is not limited to the use of Velcro and D-ring 106, 108, 110 connectors. There are many other connector types which may be used on the breaker blanket 4 to detachably secure the breaker blanket 4 to the body 36 of a circuit breaker tank 2. Such a connection system, such as snap connectors or buckles, would only need to be of the type having male and female connectors for use in detachably attaching two ends.

Although the breaker blanket insulation layer 104 utilized in the embodiment described herein is Teflon impregnated fiber glass, the insulation layer 104 may include other types of fibrous insulation, foam insulation, or combinations thereof. Suitable fibrous materials include fiberglass, polymer fibers (e.g. polypropeleyne fibers such as melt blown polypropylene fibers commercially available from the 3M company of St. Paul, Minn. under the trade designation "THINSULATE"), chopped glass fibers (e.g., magnesium aluminosilicate glass fibers commercially available under the trade designation "S2-GLASS" from Owens Corning Fiberglass Corp. of Grandville, Ohio), and ceramic oxide fibers (e.g., small diameter melt blown aluminosilicate ceramic fibers commercially available under the trade designation "FIBERFLEX DURABACK BLANKET" from Carbomudum Co., Niagara Falls, N.Y., and "CERWOOL" from Premier Refractories and Chemicals, Inc. of King Prussia, Pa., as well as ceramic oxide fibers commercially available from the 3M Company under the trade designation "NEXTEL" (e.g., aluminosilicate ceramic oxide fibers commercially available under the trade designation "NEXTEL 440," aluminoboeosilicate ceramic oxide fibers commercially available under the trade designation "NEXTEL 312," and alumna ceramic oxide fibers commercially available under the trade designation "NEXTEL 610")).

The Teflon impregnated fiber glass insulation utilized in the embodiment described herein is in the form of a lofty non-woven mat in which the fibers are entangled with or bonded to each other. The fiberglass insulation is inert and capable of withstanding at least 1000° F. Such insulation is typically a minimum R8 grade and prepared according to conventional techniques such as melt blowing, air laying, or carting. The mats can be made with thermal bonding fibers and exposed to heat to cause the thermal binding fibers to soften and bind at least some of the fibers together.

Heating System

The heating system portion of the heating insulation unit 1 is comprised of a heating unit 6 and a heating unit controller 20. The heating unit 6 is comprised of a flat elongated flexible silicon rubber 90 that is about one-eighth of an inch thick having heater ribbon of approximately 650–850 watts running therethrough. The heating element is designed with a very low watt density in watts/inch of less than 2 watts/inch. This prolongs heater life. The dimensions of the heating unit are in accordance with user specifications as it can be custom designed to meet the specifications of the customer. The heating unit controller 20, as shown in FIG. 1, is generally comprised of a Proportional Integral Derivative control (PID) 22, current transformers 24, 26, 28 and a bypass switch 30. The heating unit control circuit is shown in greater detail in FIG. 4.

The heating unit controller's 20 PID controller 22 is a device that allows the heater unit control system to incorporate temperature variables, including the temperature of the circuit breaker tank, the differential in tank temperature and a set point temperature, and the rate at which the tank temperature changes, into the control decision when activating and deactivating the heating unit 6. Prior heater unit controllers used on circuit breaker heaters simply turn the heating unit on or off upon detecting certain threshold temperatures in the tank of the circuit breaker. In the present invention, instead of simply tuning the heater unit on or off, through the PID controller 22, the controller 20 activates the heating unit 6 and directs it to heat the tank up to a certain level and then dampens the heater response to avoid overshooting the set point temperature. Dampening the heater response provides the PID controller 22 more control over the temperatures the tank will reach or stabilize at when heated. Use of prior heaters, and control systems, which heat the tank until it reaches a threshold temperature have less control over the temperature the tank will reach because the controllers do not incorporate heating variables such as the rate at which the tank temperature changed in reaching the threshold temperature. In most cases, the tank temperature will significantly overshoot the tank threshold temperature, evidencing unnecessary use of energy which could have been sold to customers.

In this embodiment, dampening the heating unit's 6 response through the PID controller 22 when heating up the tank provides the controller with the ability to control the tank temperature being modified to within plus or minus ½ degree of the set point temperature. When the tank temperature is being modified by the application of heat through the heating unit 6, the PID controller 22 modifies the heat generated by the heater so that the temperature of the tank stabilizes within plus or minus ½ degree of the set point temperature. In controlling the tank temperature to within plus or minus ½ degree of the set point temperature when the heater has been activated, the PID controller 22 unit samples and then processes data representing temperature variables which include the current temperature of the circuit breaker tank, the differential in tank temperature and a set point temperature and a rate at which the temperature of the tank changes. The PID controller 22 processes this data to determine the point at which the heater must be dampened, fully re-activated or disabled. This type of use will also lengthen heater life because of the reduction in thermal shock to the heater.

An example of how the controller 20 controls the heating unit 6 is illustrated as follows. First, the PID controller 22 is set to reflect that the set point temperature (minimum temperature that the tank should be) is normally about −10° F. degrees. The thermocouple 10 positioned on the tank 2 measures the tank 2 temperature. The weather conditions are such that they cause the outside temperature surrounding the tank to suddenly drop to approximately −20° F. Initially, in this example, the temperature of the circuit breaker tank 2 as measured and reported by the thermocouple to the controller is 0° F. degrees. As a result of the −20° F. degree temperature, the temperature of the circuit breaker tank 2 will start to drop. The controller processes data representing tank temperatures measured by the thermocouple 10 as they drop, data representing the rate at which the temperature drops and set point temperature data. Between these three temperature data entries, the controller decides when to activate the heating unit 6 and how long the heating unit 6 should remain on. When the heater unit 6 is activated by the controller, the controller continues to process data representing the difference between the actual tank temperature and the set point temperature and the rate at which changes in the difference between the actual temperature and set point temperature occur over time. This new data the controller 20 processes may cause the controller to change the length of time it will stay on or when and at what rate it dampens the heating unit 6 response. For example, if the temperature drops rapidly to −7° F., the rate at which the temperature drops will affect the initial assignment of the pulse width for heating unit 6 activation. In this case rapid drop in temperature to −7° F. will cause the heating unit to activate because the processor is anticipating what counter heating measures need to be done to keep the temperature as close to the −10° F. set point temperature as possible. When the PID controller 22 is anticipating what counter heating will need to be applied to the tank to maintain the temperature within plus or minus ½ the set point temperature of −10° F., it is calculating a curve of the drop in temperature versus time. Based on that curve, the processor determines when the heating unit should be activated. On the other hand, a slow reduction of the tank temperature to −7° F. may not cause the heater to activate. The rate at which the temperature is decreasing may be small enough that the curve the controller generates and is processing may cause the controller to determine that it is not necessary to activate the heater until −8° F. or −9° F. is reached.

Figure 4:
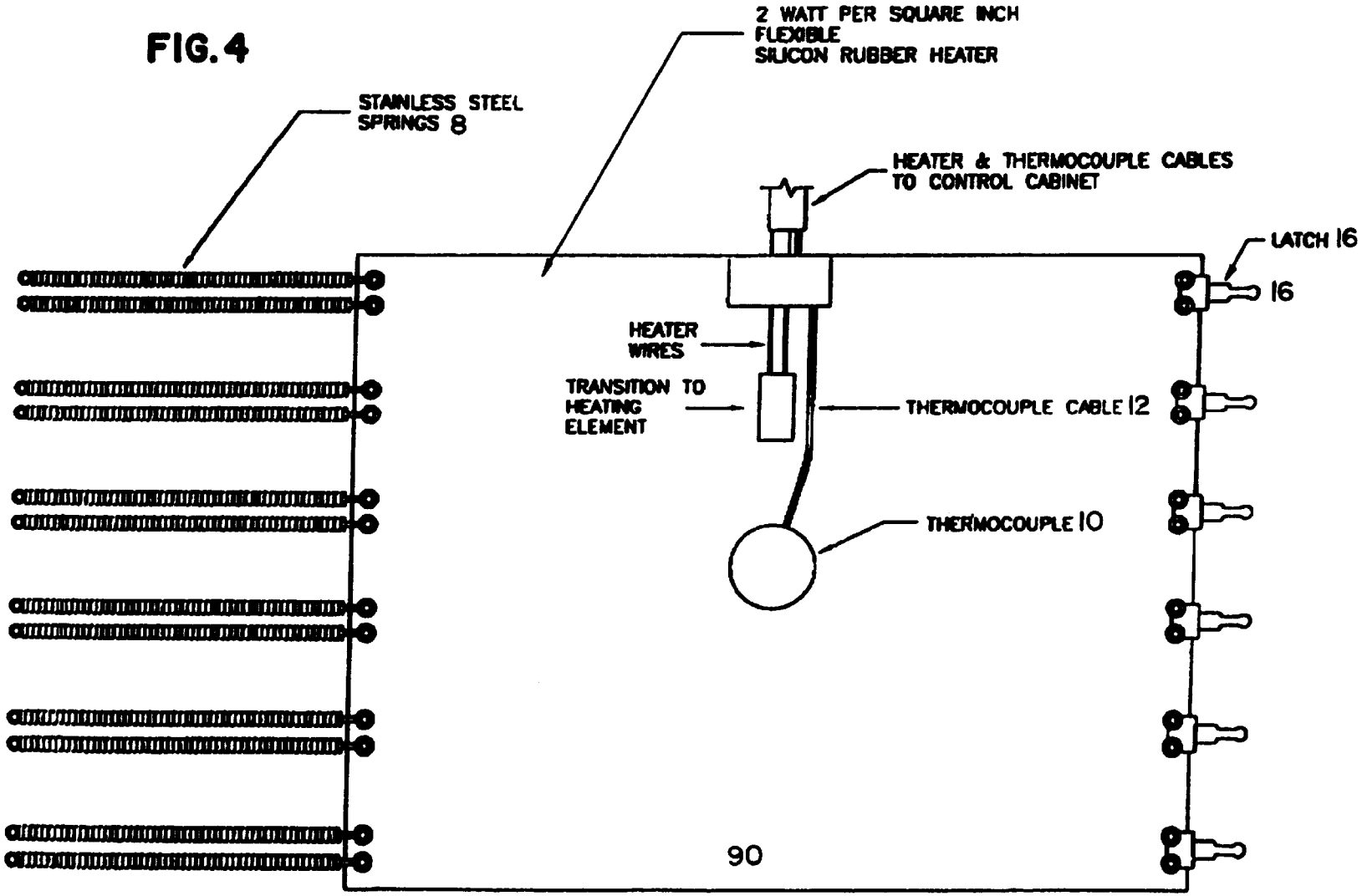
FIG. 4 is a view of the heating unit.

Referring now to FIG. 4, the circuitry of the heater control unit 6 is shown. The heater control circuitry includes a PID controller 22, current transformers 24, 26, 28 that check for continuity of the heater circuit, a contactor switch 68, a thermocouple 10, a control box heater 66, a control box heater controller 64, fuses 46, 48, 50, 52, 54, 56, 58, 60, 62, 64, terminal blocks 70, 74, 78 82 and a selector switch 44 which allows the user to select three modes of operation, off, on, and bypass.

The PID controller 22 is connected directly to the thermocouple 10 to receive a constant flow of data representing the tank temperature variables. The PID controller 22 is also directly connected to the contactor switch 68, the device that actually turns the heating unit 6 on. The heating unit 6 cannot be turned on and off directly by the PID controller 22 because the PID controller 22 does not have the correct contact size. The contact size necessary to activate the heating unit 6 can be fifteen or twenty amps. The PID controller 22 cannot switch fifteen or twenty amps. It is only capable of switching small potentials. As such, the PID controller 20 activates the heating unit 6 through the contactor switch 68.

The current transformers 24, 26, 28, which act as indicator lights, within the circuit look for openings on the heating circuit. The current transformers 24, 26, 28, have LEDs that remain on at all times when the heating circuit is operational. The LEDs within the circuit transformers 24, 26, 28, act as an indication that the circuit loops through which the current transformers 24, 26, 28 are connected and continuous. If an LED 24, 26, 28, is off, that notifies the user that there is an opening somewhere on the circuit loop which the current transformer 24, 26, 28, is in connection with. Typically, open circuits are caused by blown fuses or actual damage to the heater 6.

The PID controller is also connected directly to the selector switch 44 which allows the user to select three modes of operation, off, on and bypass. Off mode of operation allows the user to turn the entire heating unit off. In off mode of operation, noting is functioning. On mode of operation is when the controller 22 controls the functioning of the heaters in the automatic manner described above. The bypass mode of operation allows the user to bypass the controller 22 and engage the heaters in any manner the user deems appropriate. In bypass mode the user may decide to turn the heaters on so that they remain on at all times regardless of tank and set point temperatures. The PID controller is removed from the control circuit loop in bypass mode of operation.

The terminal blocks 70, 74, 78, 82 are VAC inputs 82 and VAC outputs 70, 74, 78. The terminal block 82 is the VAC input point where the customer connects the 240 volt power supply. Terminal block outputs 70, 74 and 76 illustrate the output connection points where the actual heaters are connected to the control cabinet 20.

While the foregoing detailed description of the present invention describes the invention of the preferred embodiments, it will be appreciated that it is the intent of the invention to include all modifications and equivalent designs. Accordingly, the scope of the present invention is intended to be limited only by the claims which are appended hereto.

What is claimed:

1. A circuit breaker insulation blanket comprising:

an elongated fibrous insulation encased within a fabric shell configured for being secured to the tank of a circuit breaker, wherein the shell fabric is impervious to common solvents;

first connectors attached along a first side of the shell fabric; and second connectors attached along a second side of the shell fabric;

wherein the first and second connectors engage to detachably secure the elongated fibrous insulation encased within a fabric shell around the circuit breaker tank.

2. The insulation blanket of claim 1 wherein the fibrous insulation is comprised of a Teflon impregnated fiberglass.

3. The insulation blanket of claim 1 wherein the shell fabric is Teflon impregnated.

4. The insulation blanket of claim 1 wherein the connectors include male connectors attached along a first side of the blanket and female connectors attached along a second side of the blanket, wherein the male connectors and female connectors engage to secure the insulation blanket around the circuit breaker tank upon encircling the insulation blanket around the breaker tank.

5. The insulation blanket of claim 1 wherein the connectors include a Velcro connection system attached along a first side of the blanket and D-Ring connector attached along a second side of the blanket, wherein the Velcro connection system and the D-Ring connector engages to secure the insulation blanket around the circuit breaker tank upon encircling the insulation blanket around the breaker tank.

6. A circuit breaker tank heating insulation unit comprising:

a heating system, wherein said heating system is positioned in contact with the tank of the breaker tank;

an insulation blanket detachably secured over and encircling the heating system and the circuit breaker tank, the insulation blanket being comprised of an elongated fibrous insulation encased within a fabric that is impervious to common solvents; and attachment means for detachably securing the insulation blanket to the circuit breaker tank.

7. The circuit breaker tank heating insulation unit of claim 6 wherein the heating system is comprised of a heating unit electrically connected to a heating controller, wherein the heating unit is comprised of a flat elongated flexible silicon rubber having heater ribbon running therethrough.

8. The circuit breaker tank heating insulation unit of claim 6 wherein the insulation blanket, configured for securing to the tank of a circuit breaker, is comprised of an elongated fibrous insulation encased within a fabric, wherein the fabric is impervious to common solvents.

9. The insulation blanket of claim 8 wherein the fibrous insulation is comprised of a Teflon impregnated fiberglass.

10. The insulation blanket of claim 8 wherein the fabric is Teflon impregnated.

11. The circuit breaker tank heating insulation unit of claim 6 wherein the attachment means is comprised of male connectors attached along a first side of the insulation blanket and female connectors attached along a second side of the insulation blanket, wherein the male connectors and female connectors engage to secure the insulation blanket around a circuit breaker tank upon encircling the insulation blanket around the breaker tank.

12. A circuit breaker tank heating insulation unit comprised of an elongated fibrous insulation blanket being comprised of an elongated fibrous insulation encased within a fabric that is impervious to common solvents, the blanket positioned to cover a portion of a circuit breaker tank and an entire heating system, wherein the heating system is positioned in contact with the circuit breaker tank, the heating system including a programmable controller that receives and processes temperature data in controlling the amount of heat the heating system emits.

13. The circuit breaker tank heating and insulation unit of claim 12 wherein the temperature data received by the programmable controller is comprised of data representing the temperature of the circuit breaker tank, data representing the differential in tank temperature and a set point temperature and data representing the rate at which the differential in tank temperature and set point temperature changes.

* * * * *